United States Patent [19]

Weihrauch

[11] Patent Number: 4,874,115

[45] Date of Patent: Oct. 17, 1989

[54] DISPENSER FOR PASTY OR FLOWABLE MEDIA

[75] Inventor: Georg Weihrauch, Wald-Michelbach, Fed. Rep. of Germany

[73] Assignee: Coronet-Werke Heinrich Schlerf GmbH, Wald-Michelbach, Fed. Rep. of Germany

[21] Appl. No.: 85,567

[22] PCT Filed: Nov. 4, 1986

[86] PCT No.: PCT/EP86/00634

§ 371 Date: Jul. 13, 1987

§ 102(e) Date: Jul. 13, 1987

[87] PCT Pub. No.: WO87/02971

PCT Pub. Date: May 21, 1987

[30] Foreign Application Priority Data

Nov. 12, 1985 [DE] Fed. Rep. of Germany ..... 3539999

[51] Int. Cl.[4] ..... B67D 5/42; B67D 5/22

[52] U.S. Cl. ..... 222/386; 222/47; 222/50; 401/176

[58] Field of Search ..... 222/47, 49, 50, 386; 401/176

[56] References Cited

U.S. PATENT DOCUMENTS

| | | | |
|---|---|---|---|
| 1,027,127 | 5/1912 | Harvey | 401/176 |
| 1,818,840 | 8/1931 | Butler | 401/176 X |
| 3,325,061 | 6/1967 | Ellsworth | 222/50 X |
| 3,459,340 | 8/1969 | Smith | 222/386 X |
| 3,749,284 | 7/1973 | Kloehn | 222/49 X |

*Primary Examiner*—Joseph J. Rolla
*Assistant Examiner*—Steven M. Reiss
*Attorney, Agent, or Firm*—Antonelli, Terry & Wands

[57] ABSTRACT

A dispenser for pasty or flowable media comprises a container with a delivery opening, a piston displaceably guided in the container on the wall thereof and forming the lower seal for the filled material, as well as a guide part formed by the container wall on the otherside of the piston. To permit a portionwise or continuous delivery of the filled material, the container is provided on its guide poart with an axially parallel, downwardly open slot corresponding to the total stroke of the piston and a double-walled slide is provided for the displacement of the piston and which roughly corresponds to the slot length and whose two walls engage on the container wall externally or internally on either side of the slot and whose inner wall is connected at its upper end to the piston and at the lower end to the outer wall.

8 Claims, 2 Drawing Sheets

FIG. 4
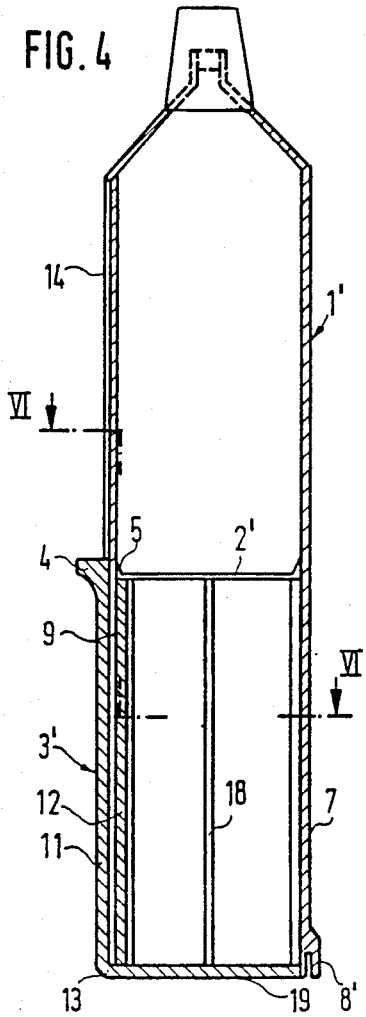
FIG. 5
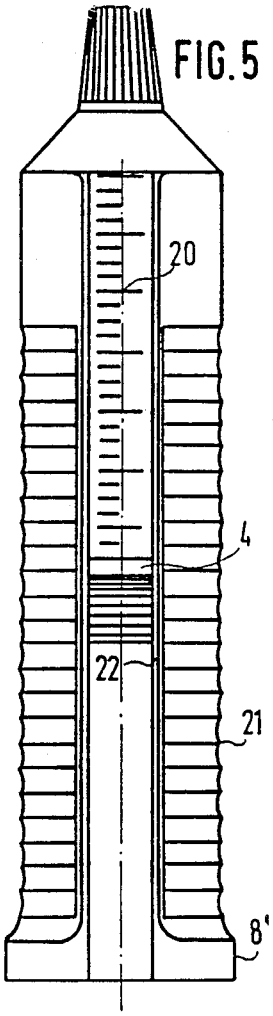
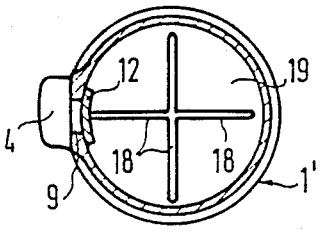
FIG. 6

DISPENSER FOR PASTY OR FLOWABLE MEDIA

BACKGROUND OF THE INVENTION

The present invention relates to a dispenser and, more particularly, to a dispenser for pasty or flowable media which includes a container having a delivery opening, a piston displaceably guided on a wall of the container in forming a lower seal for the filled material, a guide part formed by the container wall on the other side of the piston, and a device with an externally located handle for displacing the piston in a direction of the delivery opening.

Dispensers of the forementioned type are particularly used for pasty medium such as toothpaste, cosmetics, and also for foods such as, for example, mayonnaise, mustard, etc.

Dispensers have been proposed wherein the piston travels upwards in the container through a type of pumping movement on an externally accessible pressure piece due to an overpressure or underpressure and advances the filled material or charge before it. The filled material is always discharged in a portionwise manner. Additionally, such dispensers require valves at the delivery opening in order to produce an underpressure or maintain an overpressure. Thus, dispensers such as proposed in, for example, DE-OS 29 01 717 and DE-OS 31 05 859 comprise a plurality of components which must be closely toleranced thereby resulting in a dispenser which is complicated and prone to failure.

Additionally, in, for example, DE-OS 29 41 416 and DE-OS 30 07 480, dispensers are proposed wherein the piston is additionally secured to prevent a retraction or sliding back following the stroke or lifting movement, in that it is, for example, constructed in the manner of a climbing piston, which is locked by expansion parts, locating devices or disposed on a guide rod/or on the container inner wall. These constructions are also complicated and lead to sealing problems. Furthermore, in, for example, DE-AS 16 07 905 and EP-OS 0 053 329, dispenses or propose wherein springs are provided for preventing the piston from dropping.

However, these pump-like functioning dispensers have a complicated construction and are also prone to failure. Additionally, they generally only permit a portionwise delivery so that they have to be operated several times when a larger quantity is to be dispensed.

Finally, dispensers of the aforementioned type have been proposed wherein the piston is mechanically moved by an external actuation, with the lifting movement being directly manually produced (German utility models 79 08 402 and 82 29 055) or by mechanical transmission means. The first-mentioned construction suffers from the disadvantage that the container becomes ever shorter on emptying. In a known construction of the latter type (DE-OS 30 26 659), a rack is connected to the bottom of the piston and is located in a guide part connected to the container. With the rack cooperates a pinion, which is mounted in the guide part and can be rotated from the outside. However, problems are caused in this case by the guidance of the rack, as well as by the mounting of the pinion. However, it is advantageous that the filled material can be dispensed in random portions. However, it is only possible to operate it with two hands, so that for many uses, e.g. for toothpaste, the dispenser cannot be used and can only be used to a limited extent for other purposes, e.g. for cosmetics and the like.

On the basis of dispensers of the latter construction, the aim underlying the present invention essentially resides in providing a simple and more operationally reliable dispenser formed from a minimum of components, which permits both a portionwise and a continuous dispensing of the material.

In accordance with advantageous features of the present invention, a dispenser for pasty or flowable media is provided which includes a guide part with a container of the dispenser having an axially parallel downwardly open slot corresponding to a total stroke of the piston and wherein a device for displacing the piston as formed from a double-walled slide guided on a guide part and engaging on the piston and which roughly corresponds to a length of the slot.

By virtue of the above noted features of the present invention, a dispenser is provided which comprises only two components, namely, the container and piston with the double-walled slide connected thereto.

Advantageously, the piston and slide are guided on the container wall by virtue of the provision of two side walls which engage on the container externally or internally on either side of the slot and the inner wall is connected at its upper end to a piston and at its lower end to the outer wall thereby insuring an adequate guidance of the piston.

The assembly of the two parts or components of the present invention is very simple in that after filling the container in the conventional manner, i.e. from the open bottom, the piston is inserted, the doubled-walled slide is mounted on the container wall edges adjacent to the slot. By sliding the external handle, the piston is moved in a direction of the delivery opening so as to advance the filled material disposed forwardly thereof and permit the material to pass out of the discharge opening. The quality of filled material discharged is exclusively determined by the sliding movement with the hand or finger so that individual portioning is possible.

Since there is no need to provide means in a vicinity of the delivery opening, the piston can be moved up to the opening so that the container may be completely empted. Additionally, the dispenser can be readily operated with one hand in that the dispenser is engaged in the vicinity of the lower guide part and the slide is advanced, for example, with the thumb of the user. The slide position provides a criterion for the fill level in the container and there is no need for separately securing the pistion against a return or sliding back movement although this generally does not occur. The piston can readily be advanced up to the filled material or moved for compressing the latter and the delivery opening can be positioned along a longitudinal axis of the container as well as laterally, for example, formed as a spout.

In accordance with further features of the present invention, a dispenser is provided, in at least a region containing the filled material with a guide overlapping an external wall of the doubled-walled slide. By virtue of this arrangement it is ensured that the doubled-walled slide, the two walls of which are only interconnected in a vicinity of the lower end, is stable in all positions as a result of the additional guide overlapping the outer wall. This particularly avoids a supporting of the outer slide wall, however, it is also possible in accordance with the present invention for the guide to extend to the lower end of the container guide part so that the outer slide wall is also externally guided over its entire length and over the entire stroke path. This additional guidance also contributes to the stabilization of the container wall and further insures a completely satisfactory guidance of the piston in the dispenser or container. Additionally, the overall guidance can be aided in that the inner and outer slide walls, which are, for example, partly cylindrical in accordance with the cross-sectional shape of the container, engage over a larger region of the container wall.

Advantageously, the handle of the dispenser is substantially or roughly level with the piston which leads to a favourable construction for handling purposes, in that the complete container can be engaged in a vicinity of the guide part while also providing an adequate clearance for pressing the slide.

In order to lead to an additional reinforcement or stiffening of the container into an improved guidance of the piston the piston has, on an underside thereof downwardly extending ribs engaging on the inner wall of the guide part of the container.

Additionally, in accordance with still further features of the present invention, the lower end of the slide may be shaped as a base guided in a guide part of the container and be connected by means of ribs 18 to the piston the additional base connected to the slide also formes the lower seal for the container guide part so that the construction is particularly satisfactory from an optical standpoint.

It is also possible in accordance with the present invention to provide a dispenser when the slide and/or the guide is provided with several notches or the like for enabling a portionwise delivery of the filled material, such an arrangement provides the option or the user to skip several notches so that the desired quantity is then discharged.

It is also possible in accordance with the present invention to provide a linear scale on the external portion of the container whereby a discharge of defined portions of a specific weight or volume can be realized.

In order to insure a complete emptying of the container, advantageously, according to the present invention, the contour of the piston is adapted to the top of the inner contour of the container in a vicinity of the delivery opening.

The inventive construction can be used with containers having a circular, oval, rectangular cross-section with rounded corners and the like in an equally advantage manner. Double-walled containers are also possible, it merely being necessary to provide corresponding guides in the jacket of both container walls. The discharge or delivery opening can also be constructed in the manner of a nozzle for squeezing out the filled material. It can also have inserts or cross-sections shaping the discharged strand. It is also possible to provide several channels in the vicinity of the delivery openings, so that different or different colored filled materials can be discharged in juxtaposed manner in one strand.

The invention is described in greater detail hereinafter relative to non-limitative embodiments and the attached drawings.

BRIEF DESCRIPTION OF THE DRAWINGS

FIG. 4 is a longitudinal cross-sectional view through another dispenser constructed in accordance with the present invention;

FIG. 5 is a planned view of the dispenser of FIG. 4; and

FIG. 6 is a cross-sectional view taken along the line VI—VI in FIG. 4.

DETAILED DESCRIPTION

Figure 1:
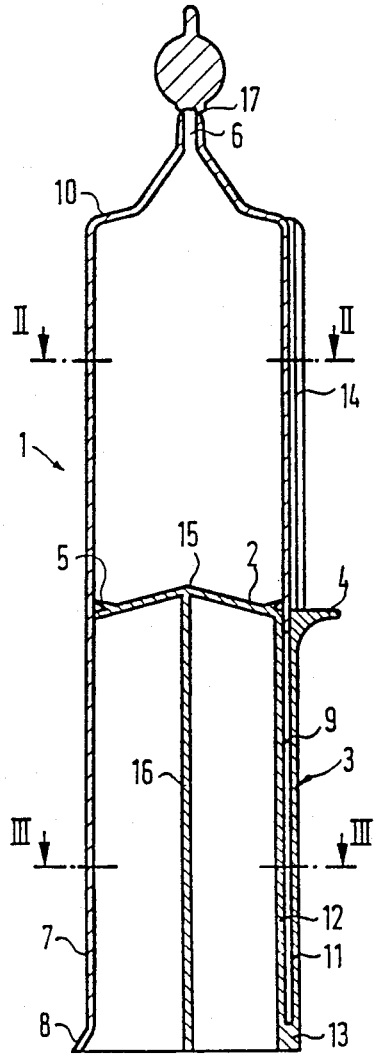
FIG. 1 is a longitudinal cross-sectional view through a dispenser constructed in accordance with the present invention.

Referring now to the drawings when like reference numerals are used through the various views to designate like parts and, more particularly, to FIG. 1, according to this Figure, a dispenser, constructed in accordance with the present invention includes a container generally designated by the reference numeral 1 having, for example, a cylindrical shape, a piston 2 displaceably guided therein and a slide connected thereto and a handle 4 in a form of a push key.

The piston 2, which is optionally additionally provided with packing washers 5, is located roughly in the central region of container 1 in its starting position. The upper region between piston 2 and delivery opening 6 is filled with a pasty or liquid medium, while the container 1 forms a guide part 7 with a substantially hollow cylindrical shape on the other side of the piston 2. The guide part 7 has on lower edge thereof a reinforcement 8. In its lower guide part 7, container 1 has an axially parallel longitudinal slot 9, which extends to the lower end and is open there. The length of slot 9 corresponds to the total stroke of piston 2 between the position shown in FIG. 1 and a position in the vicinity of a neck 10 of the container 1.

Slide 3 is constructed in double-walled manner and has an outer wall 11 and an inner wall 12, connected to one another by a web 13 at the lower end thereof and forms a type of slender U. The inner wall 12 is connected at its upper end to piston 2. As shown more particularly in FIG. 3, the two walls 11, 12 of the slide generally designated by the reference numeral 3 engage on the wall of the container 1 on either side of longitudinal slot 9. Thus, the slide 3 is guided on the container wall on both sides.

In the illustrated embodiment a further guide 14 is provided on the outer wall of the container 1 and externally engages over the outer wall 11 of the slide 3 in the manner of a groove and tongue guide. Guide 14 should be present at least in the upper region of the container 1 and extend to the upper end of the slide 3, so that the latter is also externally guided in the starting position of the piston 2. It can naturally also be extended down to the lower edge 8 of the container 1.

In the illustrated embodiment, the piston 2 is curved upwards to an apex 15, the contour of the top of the piston 2 corresponding to the contour on the inside of container 1 in the vicinity of the neck 10, so as to permit a complete emptying of the container 1. Additional ribs 16 are shaped onto the bottom of the piston 2 and engage on the inside of the wall of the container 1 so as to give piston 2 an additional guidance and also stiffen the container.

Figure 2:
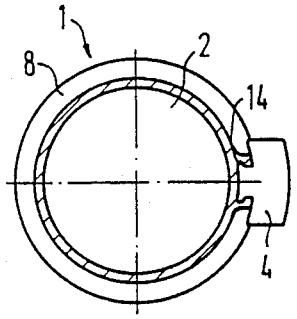
FIG. 2 is a cross-sectional view taken along the line II—II in FIG. 1.
Figure 3:
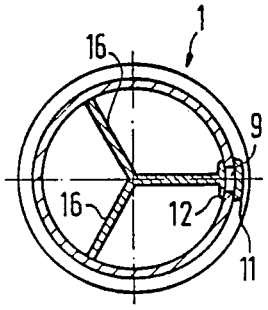
FIG. 3 is a cross-sectional view taken along the line III—III in FIG. 1.

In the embodiment according to FIGS. 1 to 3, the dispensing opening 6 is narrowed in nozzle-like manner and closed by a guarantee seal 17 which, when removed, permits the use of the dispenser.

Differing from the embodiment according to FIGS. 1 to 3, the embodiment according to FIGS. 4 to 6, e.g. in the form of a paste tube, has a base part 19 sealing the bottom of a container generally designated by the reference numeral 1', which is shaped on a slide generally designated by the reference numeral 3'; and guided within container 1'. Base part 19 is connected by ribs 18 to a piston 2' so that there is once again a better guidance and stabilization and in particular a tilting of the piston 2' is avoided, much as through the guide ribs 16 according to FIGS. 1 and 3. A reinforcement 8' is provided at a lower edge of the guide part 7.

In the vicinity of the guide 14, the externally overlapping slide 3' is provided a scale 20, whose direct reading is permitted by the push key 4.

The outside of the container 1' can be provided with an all-round corrugation 21, which assists operation. The push key 4 can also be provided on its bottom with a corrugation 22.

In the claims:

1. Dispenser for pasty or flowable media, the dispenser comprising a container for accommodating the media, a delivery opening provided on the container for enabling a dispensing of the media, a piston displaceably guided along a wall of the container and forming a lower seal for the media accommodated in the container, a guide part formed by the wall of the container at a position below the lower seal formed by the piston, displacing means including an externally located handle for displacing the piston in a direction of the delivery opening, said displacing means including a slide having a downwardly open slot for accommodating a portion of the wall of the container, said downwardly open slot being disposed in parallel to a longitudinal axis of the container and having a length corresponding to a total stroke of the piston, said downwardly opening slot being defined between an internal wall connected to an upper end of the piston and an external wall connected at one end to the externally located handle such that the slide is a double-walled slide guided on the guide part, and wherein at least one additional guide means is provided on the external portion of the container at least in an area containing the filled media.

2. Dispenser according to claim 1, wherein the handle is substantially level with the piston.

3. Dispenser according to claim 1, wherein notch means are provided for enabling a portionwise delivery of the filled media.

4. Dispenser according to claim 1, wherein a contour of the piston is adapted to the top of an inner contour of the container in a vicinity of the delivery opening.

5. Dispenser according to claim 1, wherein the piston is provided with downwardly extending ribs on an underside thereof, said ribs being engagable with an inner wall of the guide part.

6. Dispenser according to claim 5, wherein a base portion is provided and is connected to the downwardly extending ribs.

7. Dispenser according to claim 1, wherein a linear scale is provided on a exterior surface of the wall of the container.

8. Dispenser according to claim 7, wherein the scale is provided on an exterior portion of the wall of the container in a vicinity of the at least one additional guide.

* * * * *